US006098839A

United States Patent [19]

Hunnell

[11] Patent Number: 6,098,839

[45] Date of Patent: Aug. 8, 2000

[54] ARTICLE DISPENSING ASSEMBLY

[75] Inventor: Jack E. Hunnell, Durham, N.C.

[73] Assignee: Triangle Biomedical Sciences, Inc., Durham, N.C.

[21] Appl. No.: 09/074,255

[22] Filed: May 7, 1998

[51] Int. Cl.[7] ..... B65H 1/00

[52] U.S. Cl. ..... 221/197; 221/289

[58] Field of Search ..... 221/289, 197, 221/268, 271, 272, 276, 258, 256

[56] References Cited

U.S. PATENT DOCUMENTS

| | | | |
|---|---|---|---|
| Re. 30,595 | 4/1981 | Covington et al. | 422/63 |
| 2,829,767 | 4/1958 | Scripture | 206/73 |
| 3,179,314 | 4/1965 | Hodgson et al. | 222/561 |
| 3,235,068 | 2/1966 | Asnes et al. | 206/456 |
| 3,416,250 | 12/1968 | Schweers | 40/79 |
| 3,503,496 | 3/1970 | Kovarik et al. | 206/456 |
| 3,799,409 | 3/1974 | Goerke | 222/561 |
| 4,077,845 | 3/1978 | Johnson | 195/103.5 K |
| 4,114,166 | 9/1978 | Driscoll et al. | 354/76 |
| 4,142,863 | 3/1979 | Covington et al. | 422/63 |
| 4,151,915 | 5/1979 | Levine et al. | 206/456 |
| 4,151,931 | 5/1979 | Scherer et al. | 221/226 |
| 4,187,077 | 2/1980 | Covington et al. | 422/63 |
| 4,190,420 | 2/1980 | Covington et al. | 422/63 |
| 4,301,116 | 11/1981 | Ida et al. | 422/65 |
| 4,305,526 | 12/1981 | Pfleger | 221/197 |
| 4,334,361 | 6/1982 | Gorski et al. | 33/174 T |
| 4,387,512 | 6/1983 | Gorski et al. | 33/174 T |
| 4,512,952 | 4/1985 | Blanding et al. | 422/63 |
| 4,776,689 | 10/1988 | Maclay | 353/111 |
| 4,834,246 | 5/1989 | Inoue et al. | 206/631 |
| 4,929,426 | 5/1990 | Bodai et al. | 422/63 |
| 5,043,143 | 8/1991 | Shaw et al. | 422/65 |
| 5,081,038 | 1/1992 | Sugaya et al. | 436/46 |
| 5,102,624 | 4/1992 | Muraishi | 422/64 |
| 5,119,573 | 6/1992 | Dentella | 40/367 |
| 5,122,343 | 6/1992 | Ishizaka et al. | 422/66 |
| 5,511,690 | 4/1996 | Calhoun et al. | 221/197 |

FOREIGN PATENT DOCUMENTS

| | | |
|---|---|---|
| 2 235 163 | 2/1991 | United Kingdom . |
| 2235163A | 2/1991 | United Kingdom . |

*Primary Examiner*—Kenneth W. Noland
*Attorney, Agent, or Firm*—Steven J. Hultquist; William A. Barrett

[57] ABSTRACT

An article dispensing apparatus for storing and sequentially translating support articles. The assembly can be constructed, arranged, and adapted to be removeably positioned in operative relation to a support article labeling device. The assembly includes a sequencing mechanism and a housing containing the sequencing mechanism. The assembly can optionally include a preloaded removable magazine. The sequencing mechanism captures a stacked array of support articles and translates a lower-most positioned support article from the stacked array to the labeling device. The housing can also include at least one adjustable stop element. The adjustable stop element cooperates with the sequencing mechanism to prevent misregistration of the bottom-positioned support article.

53 Claims, 10 Drawing Sheets

ARTICLE DISPENSING ASSEMBLY

BACKGROUND OF THE INVENTION

1. Field of the Invention

This invention relates to dispensing assemblies for dispensing individual articles and, more particularly, to cassette dispensing assemblies for dispensing sample support cassette articles for subsequent histological analysis.

2. Description of the Related Art

Biomedical laboratories commonly utilize rectangular plastic trays of a specified size and shape, called sample cassettes, to hold biological samples for histological analysis or other testing. The cassettes are single use disposable articles which are stored in bulk and require individual labeling and dispensing prior to use. The cassettes are generally rectangular and have an angled face for labeling which can be presented to a marking device. One device for marking and dispensing sample cassettes is known as the Shur-Mark Cassette labeler. Another device for labeling and dispensing is illustrated in UK Patent Application GB 2 235 163 A, filed Jun. 28, 1990 in the name of Pauline D. Lamb. Lamb discloses a device for marking supports for laboratory samples, for example (a) laboratory tissue processing cassettes made of plastic material and (b) glass laboratory or microscope slides.

The marking device disclosed in the Lamb patent application comprises a marking stylus operatively coupled to a plotter mechanism for applying a selected marking to the sample support article at a marking locus, with means for holding a sample support article in selected position at the marking locus for the marking operation. This marking device includes a mechanism for ejecting the sample support article from the holding means subsequent to marking of the sample support article.

The sample support articles are supplied to the marking locus of the device disclosed in the Lamb patent application from a magazine mounted above a slide tray extending from an upper feed end downwardly to a lower discharge end communicating with the aforementioned holding means which secure the sample support article during its marking. The magazine is manually loaded, one-by-one, with the sample support articles to form a stack of the articles in the interior volume of the magazine. At the lower portion of the magazine is a rotary reciprocating block of a selected shape which permits the release of a single sample support article at a time, from the magazine, as the block is rotated to its release position and then returned to its "blocking" position, to retain the next succeeding sample support article in the magazine, pending release on the next rotation cycle of the block member.

Although the device of the Lamb patent application is generally reliable and effective for its intended use, it nonetheless suffers from deficiencies which limit its broad applicability.

The magazine in the Lamb device is difficult to manually load in a quick manner, such as may be desired for continuous operation of the device in the service of labeling a large number of support articles. Thus, the sample support articles dropped into the upper end of the magazine housing may, in dropping onto the existing stack of articles, become misregistered in relation to the already stacked articles, with the result that the misregistered article may have to be manually re-registered, or the labeling device may have to be shaken or tapped to cause the misregistered article to properly reseat itself in position on the existing stack of the support articles.

Such treatment of the labeling device may in turn cause damage to the device itself and/or cause additional support articles in the previously existing stack to themselves become misregistered. In addition, manual loading of the magazine in the Lamb device is time-consuming, in terms of the associated technician's time, which otherwise could be usefully employed in other laboratory operations.

In addition to the difficulties associated with loading the Lamb device, the reciprocating block mechanism for ejecting the cassettes can function improperly. The block acts as both the release and retention member which can cause misregistration of stacked cassettes.

Accordingly, the Lamb device is difficult to load in a quick fashion while insuring accurate alignment and stacking of the support articles in the vertical feed hopper, and loading in any event is time-consuming and labor intensive. Further, the reciprocating block release mechanism can cause misalignment and consequent improper sample cassette dispensing.

The majority of commercially available cassette articles in use in Europe have a frontal surface for labeling which defines a face angle of 30° with respect to the bottom main surface of the cassette article. A majority of cassette articles in use in the United States have a frontal surface for labeling which defines a face angle of 45° with respect to such bottom surface of the cassette article, while cassette articles with a 30° face angle are also significantly used. In Japan, 40° cassette articles are predominantly employed. The Lamb patent application device readily accommodates the 30° cassette articles, but does not permit the 45° cassette articles or 40° cassette articles to be easily marked in use of the device.

SUMMARY OF THE INVENTION

The aforementioned problems are resolved by a sample support cassette article dispensing assembly for storing and sequentially translating sample support articles, the assembly constructed, arranged, and adapted to be removeably positioned in operative relation to a support article labeling device. The assembly includes a sequencing mechanism and a housing containing the sequencing mechanism. Optionally, the housing can be adapted for receiving a preloaded magazine for holding sample support cassette articles. The sequencing mechanism captures a stacked array of support articles and translates a bottom-positioned support article from the stacked array to the labeling device. The housing can optionally include at least one adjustable stop element comprising a ledge formed by an edge of an opening in the housing. The stop element cooperates with the sequencing mechanism to prevent misregistration of the bottom-positioned support article, independent of the cassette face angle.

BRIEF DESCRIPTION OF THE DRAWINGS

These and other features, aspects, and advantages of the present invention will become better understood with regard to the following description, appended claims, and accompanying drawings where:

DETAILED DESCRIPTION OF THE INVENTION AND PREFERRED EMBODIMENTS THEREOF

Figure 1:
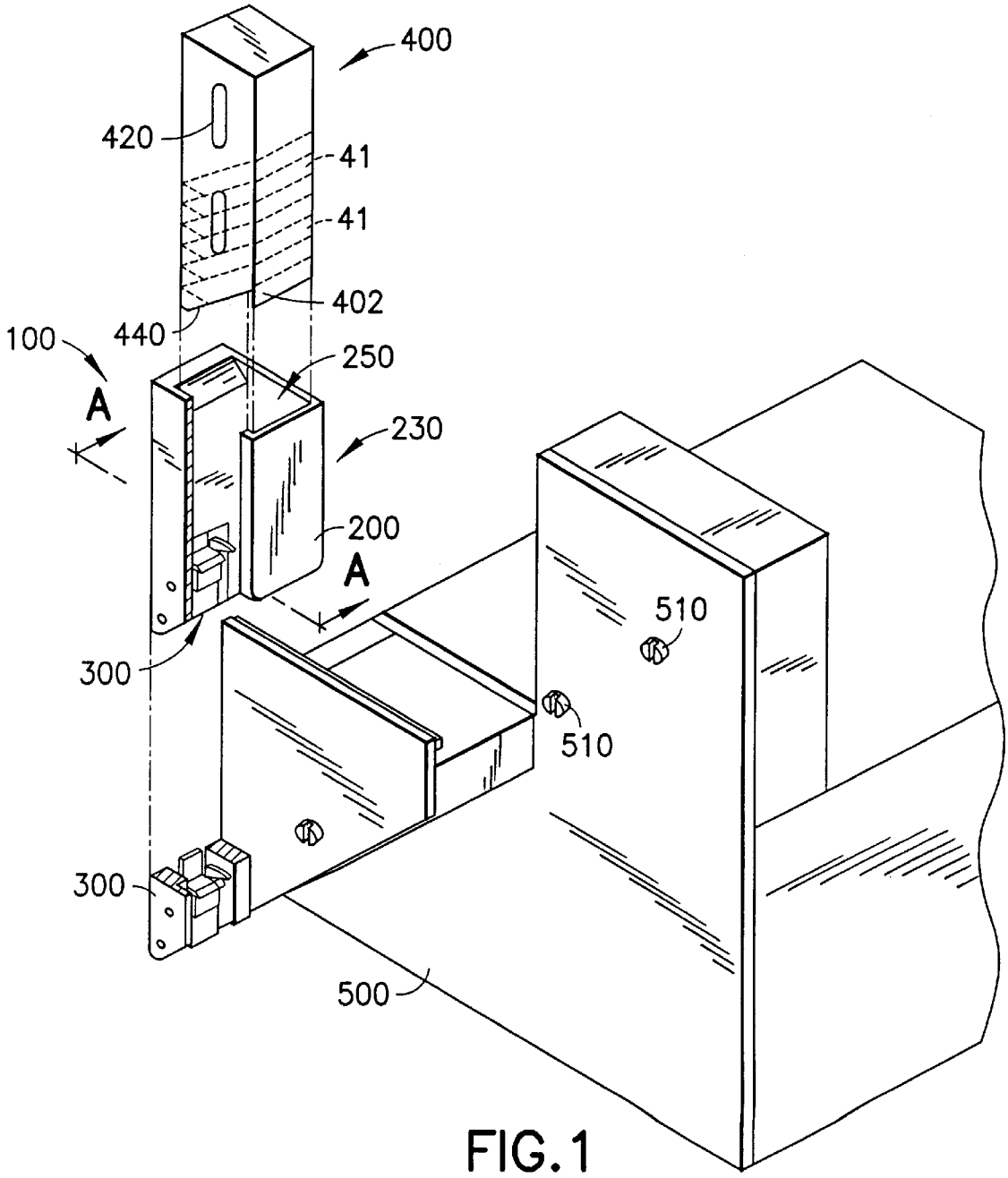
FIG. 1 shows an article dispensing assembly for storing and sequentially translating articles.

FIG. 1 illustrates an article dispensing apparatus 100 for storing and sequentially translating support articles 41. Assembly 100 may also dispense articles for subsequent labeling or may also receive labeled articles. The apparatus is constructed, arranged, and adapted to be removeably positioned in operative relation to an article labeling device 500. The embodiment of apparatus 100 depicted in FIG. 1 includes base support 230 and magazine 400. Base support 230 includes housing 200 containing a sequencing mechanism 300. A cut away view of housing 200 is depicted to illustrate the location of sequencing mechanism 300 within the housing. Sleeve 250 of housing 200 is constructed and arranged to directly hold articles in a first embodiment or to removeably mount a magazine 400 containing a stacked array of articles (cassettes 41) in a second embodiment. Magazine 400 has a dispensing end 440 insertable into housing sleeve 250 and a support leg 402 for securing magazine 400 into operative position inside housing 200. View windows 420 are provided on the side walls of magazine 400 to monitor dispensing of cassettes 41. In both embodiments shown the articles are cassettes of a conventional and known type as used for containment, storage, and presentation of tissue samples for histological analysis. The cassettes 41 are illustrative of exemplary articles which can be dispensed by the teachings of the present invention.

Figure 2:
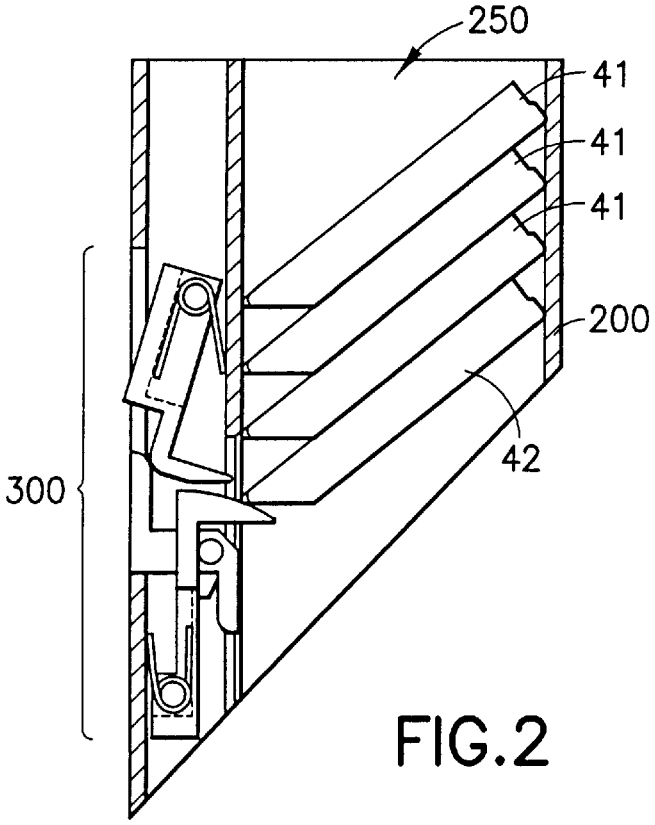
FIG. 2 is a side view of an embodiment of a housing of the present invention.

FIG. 2 is a side view of an embodiment of housing 200 containing sequencing mechanism 300. The cassettes 41 are held directly within sleeve 250 or, optionally inside magazine 400 as depicted in FIG. 1. An array of cassettes 41 are held within housing 200 by sequencing mechanism 300, which secures bottom-positioned support article 42.

Figure 3:
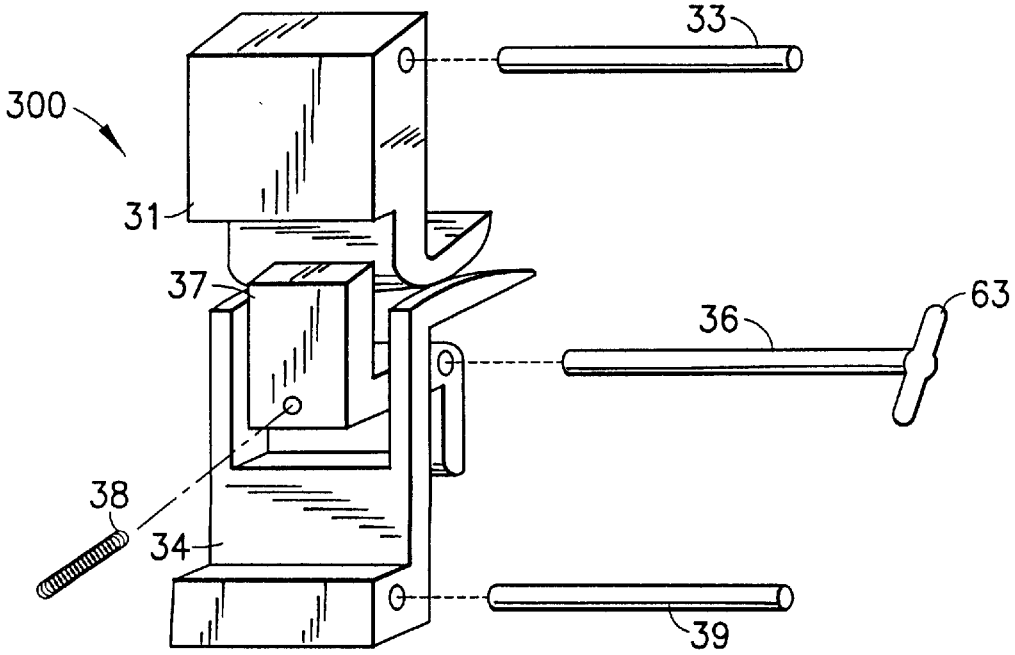
FIG. 3 is a perspective view of the components of the sequencing mechanism of the present invention.
Figure 20:
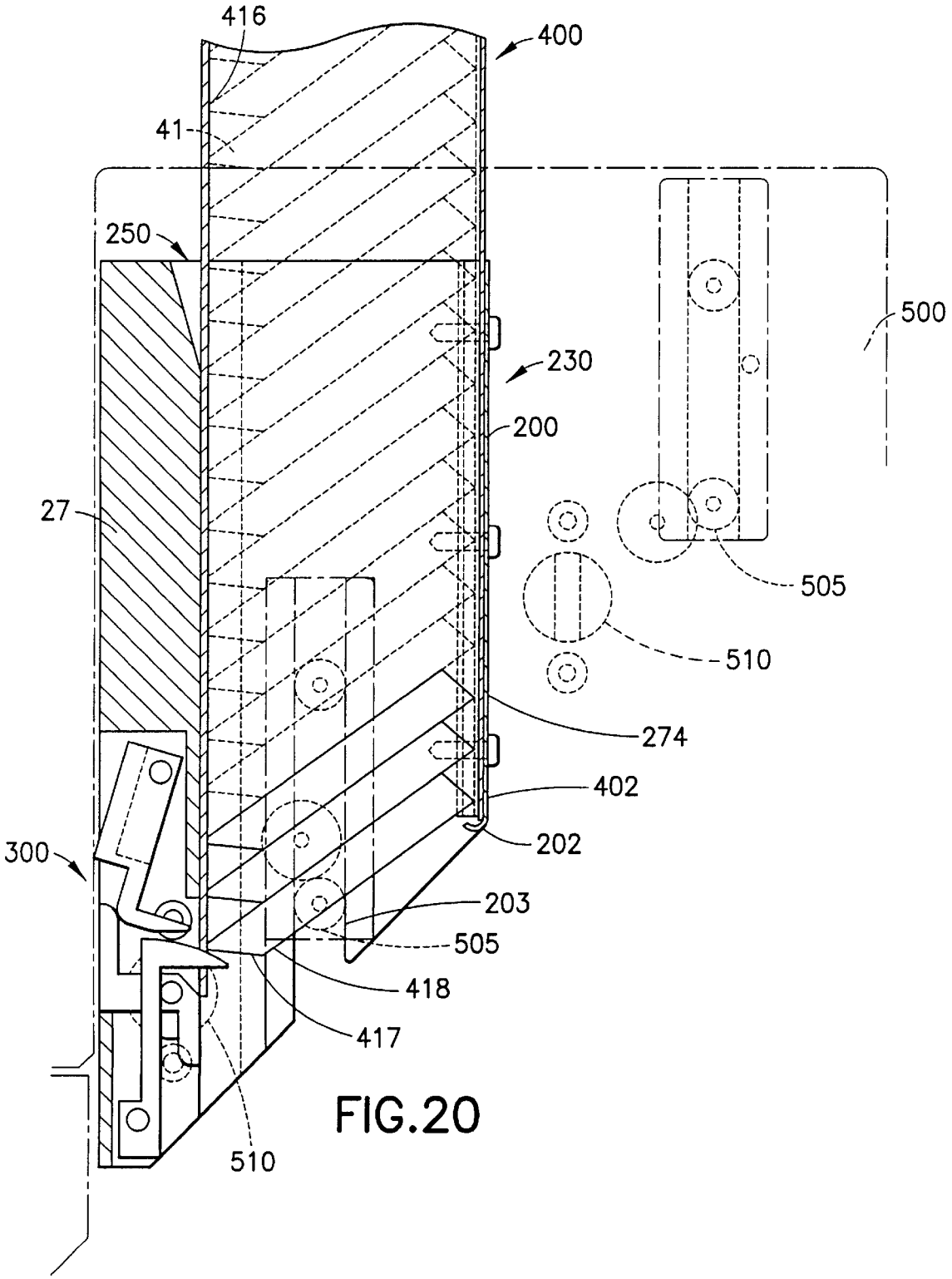
FIG. 20 is a sectional view of an embodiment of the housing along line A—A of FIG. 1.

FIG. 3 illustrates the components of the sequencing mechanism 300 in operative relationship. The sequencing mechanism 300 includes an actuator 37 mounted on a drive shaft 36. Set screw 38 is used to secure the actuator 37 to the shaft 36 so that actuator 37 rotates with drive shaft 36. Drive shaft 36 includes a keyed end 63 to mate with driver 510 of labeling machine 500 as depicted in FIGS. 1 and 20. Catching member 31 is mounted on shaft 33 and rotates about shaft 33 when actuator 37 pushes against catching member 31. Holding member 34 is mounted on shaft 39. The rotational operation among actuator 37, catching member 31 and holding member 34 is described more fully below.

Figure 4:
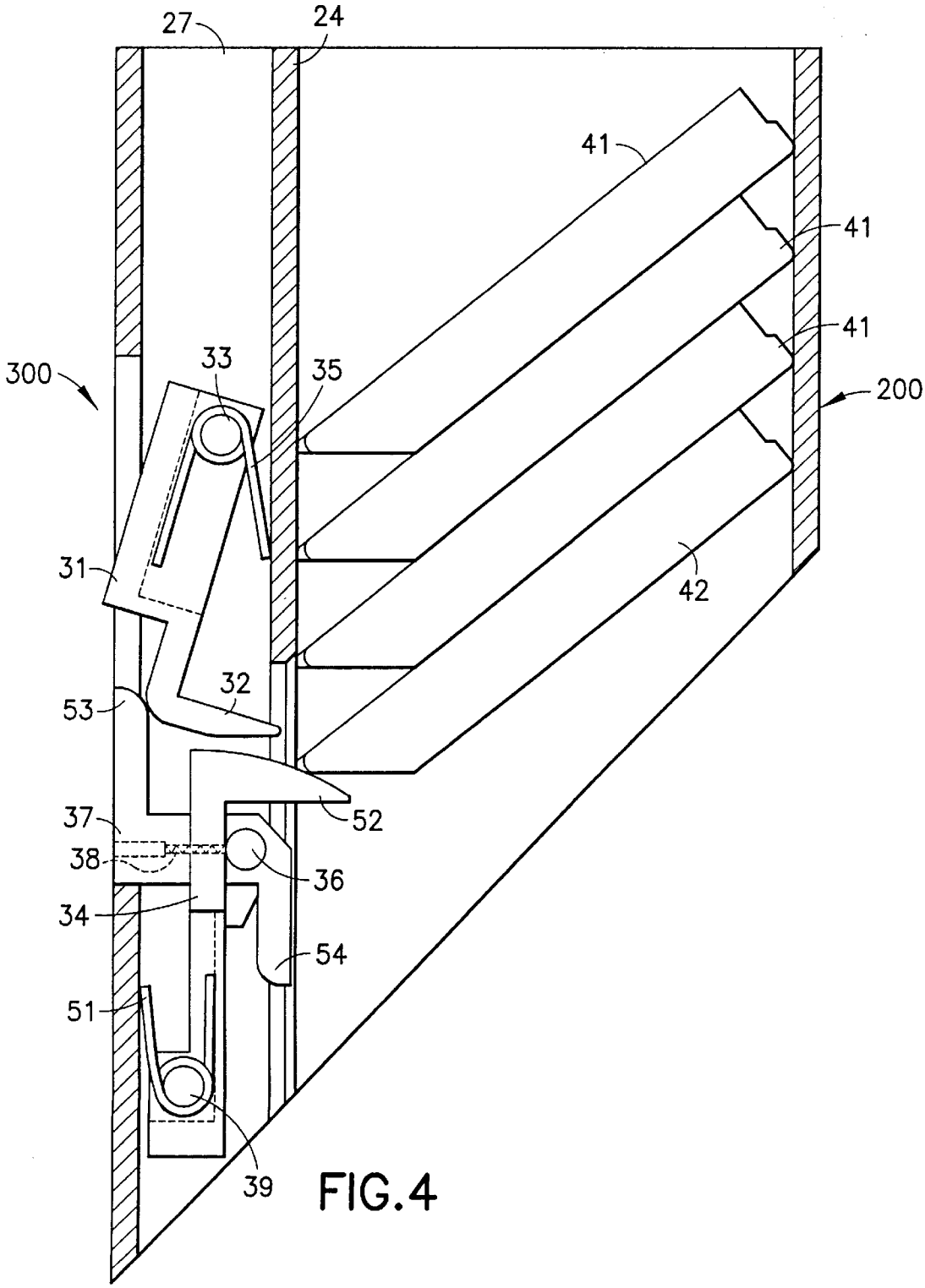
FIG. 4 is a cross-sectional side view of an embodiment of a housing of the present invention detailing the sequencing mechanism.

FIG. 4 is a side view of an embodiment showing housing 200 containing sequencing mechanism 300 which captures a stacked array 41 of support articles and translates bottom-positioned support article 42 from stacked array 41 to the labeling device 500 depicted in FIG. 1. Sequencing mechanism 300 includes a catching member 31, a holding member 34, and an actuator 37.

Catching member 31 is mounted to housing 200 and is designed to catch stacked array 41 during sequential translation. Catching member 31 is rotatably mounted between first sidewall 27 and opposite second sidewall 28 (not shown) of the housing on shaft 33. Catching member 31 includes a projection 32 to retain stacked array 41 above the bottom-positioned support article 42 and to prevent multiple support articles from being released during sequential translation. Wall 24 of housing 200 prevents projection 32 from disturbing a desired orientation of bottom-positioned support article 42 by limiting the rotation of catching member 31 about its mounting shaft. Shaft 33 is rotatably mounted between the first sidewall 27 and the opposite second sidewall 28 (not shown), with the catching member 31 fixed to the first shaft. Spring 35 restores catching member 31 to neutral position, after the sequential translation is complete.

Still referring to FIG. 4, a side view is provided of housing 200 containing sequencing mechanism 300 and holding member 34 mounted to housing 200 and designed to hold and then release the lower-most article 42 in stacked array 41. The holding member 34 is rotatably mounted on shaft 39 between first sidewall 27 and opposite second sidewall 28 (not shown). The holding member 34 is biased into contact with shaft 36 by spring 51. Holding member 34 includes at least one projection 52 designed to restrain the bottom-positioned support article 42 in a fixed position before labeling by the support article labeling device 500 (depicted in FIG. 1). Projection 52 includes a curved upper surface to allow for release of article 42 and to control the rate of release of the bottom-positioned support article 42. Shaft 39 is rotatably mounted between first sidewall 27 and opposite second sidewall 28 (not shown). The holding member 34 rotates about the axis of shaft 39. Spring 51 restores the restraining member to a neutral position after the sequential translation is complete.

Actuator 37 is mounted to housing 200 and operatively coupled to catching member 31 and holding member 34 to selectively and sequentially translate support articles from stacked array 41. Actuating member 37 is rotatably mounted on actuator shaft 36 between first sidewall 27 and opposite second sidewall 28 (not shown). The actuator member 37 includes a first arm 53 engaging and activating the catching member 31 and a second arm 54 engaging and activating the holding member 34. Actuator drive shaft 36 is rotatably mounted between first sidewall 27 opposite second sidewall 28 (not shown) of housing 200. The actuating member 37 is fixed to the actuator drive shaft 36 by set screw 38. The actuator shaft further includes a keyed end illustrated in FIG. 3 engaging a drive 510 (illustrated in FIGS. 1 and 20) of the support article labeling device 500 to drive the actuator 37 and cause sequential translation. Set screw 38 is threadably received in actuator 37 for fixing the actuator member to the actuator 37 shaft 36 to prevent rotational slippage.

Figure 5:
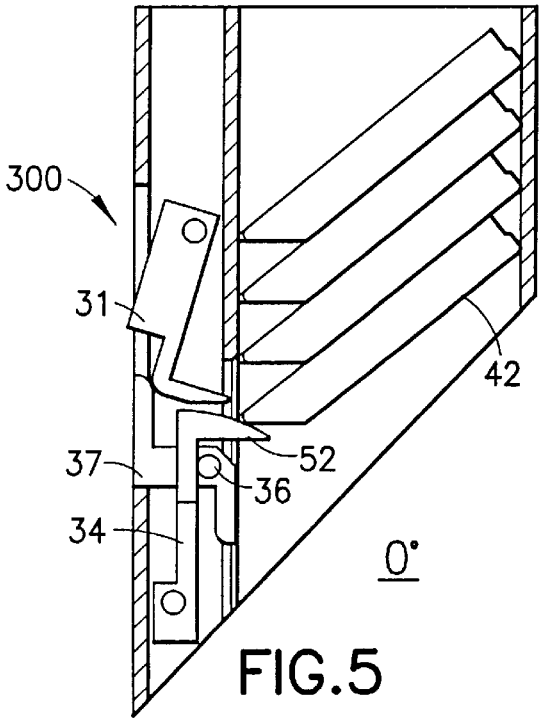
FIG. 5 is a cross-sectional view of an embodiment of a sequencing mechanism at zero degrees of rotation.

FIGS. 5 through 12 illustrate the action of sequencing mechanism 300 through the actuation cycle at various degrees of rotation. FIG. 5 illustrates the actuator member 37 at zero degrees of rotation, and the sequencing mechanism 300 is in an inactive, neutral position. Holding member 34 is biased against shaft 36 by spring 51 (shown in FIG. 4) in neutral position and restrains the bottom-positioned article 42 on the upper surface of projection 52. Catching member 31 rests in a neutral position biased against actuator 37 by spring 35 (shown in FIG. 4).

Figure 6:
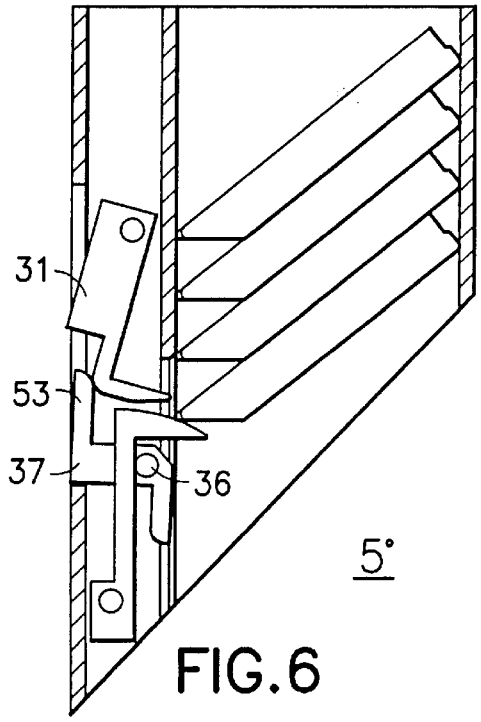
FIG. 6 is a cross-sectional view of an embodiment of a sequencing mechanism at five degrees of rotation.

In FIG. 6 actuator member 37 is rotated five degrees (driven by drive shaft 36, which is being rotated by drive 510 of labeling device 500 as shown in FIGS. 1 and 20). As actuator 37 rotates, first arm 53 begins engaging catching member 31.

Figure 7:
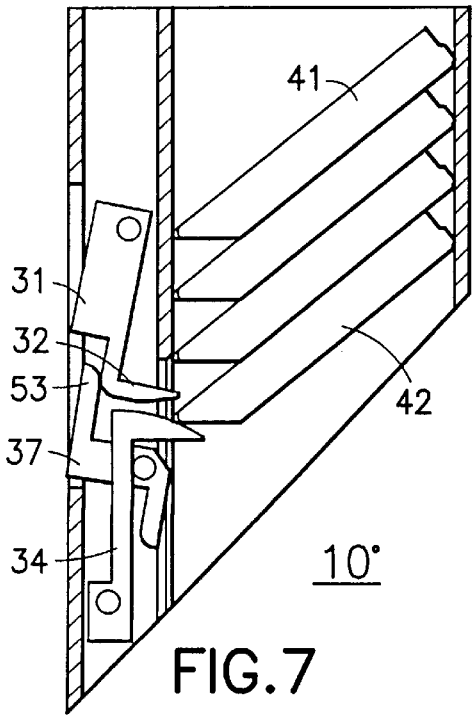
FIG. 7 is a cross-sectional view of an embodiment of a sequencing mechanism at ten degrees of rotation.

FIG. 7 shows actuator 37 rotated ten degrees. The actuator proceeds to rotate holding member 31 and to push projection 32 into stacked array 41 to retain the stacked array 41 above the bottom-positioned support article 42. The holding member 34 continues to restrain bottom-positioned support article 42.

Figure 8:
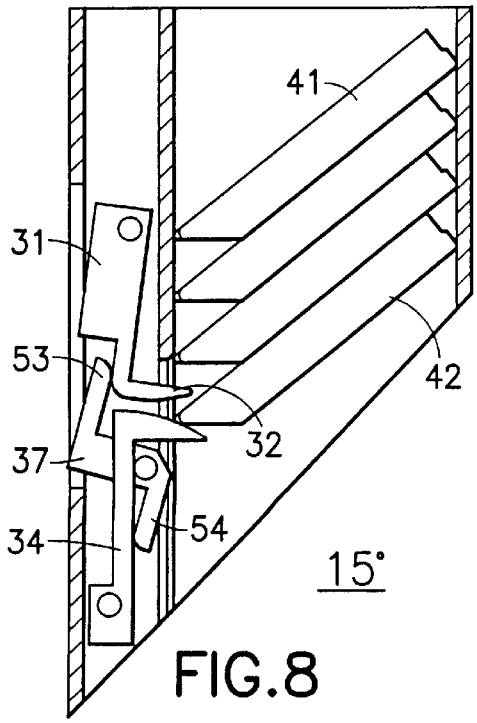
FIG. 8 is a cross-sectional view of an embodiment of a sequencing mechanism at fifteen degrees of rotation.

FIG. 8 shows actuator member 37 rotated fifteen degrees. The actuator 37 continues rotating catching member 31 into stacked array 41 to ensure projection 32 captures stacked array 41 above the bottom-positioned support article 42. Arm 54 of actuator member 37 begins to engage holding member 34.

Figure 9:
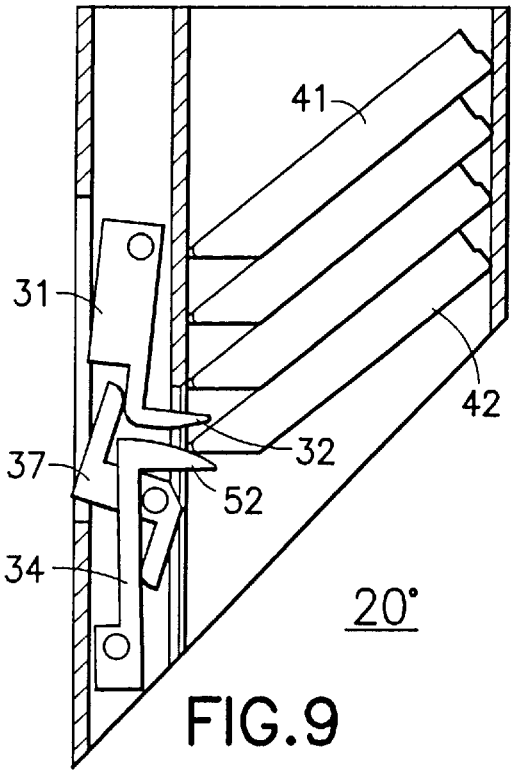
FIG. 9 is a cross-sectional view of an embodiment of a sequencing mechanism at twenty degrees of rotation.

FIG. 9 shows actuator 37 rotated twenty degrees. Actuator member 37 continues rotating catching member projection 32 into stacked array 41, and rotates holding member 34 to withdraw projection 52 to retract and begins to release bottom-positioned support article 42.

Figure 10:
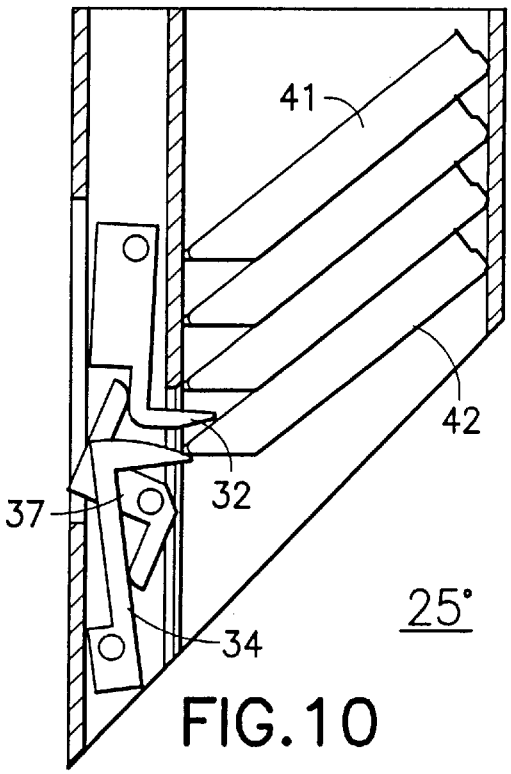
FIG. 10 is a cross-sectional view of an embodiment of a sequencing mechanism at twenty-five degrees of rotation.

FIG. 10 shows actuator member 37 rotated twenty-five degrees. The actuator 37 continues pushing catching member projection 32 into stacked array 41, and holding member 34 is nearly releasing the bottom-positioned support article 42.

Figure 11:
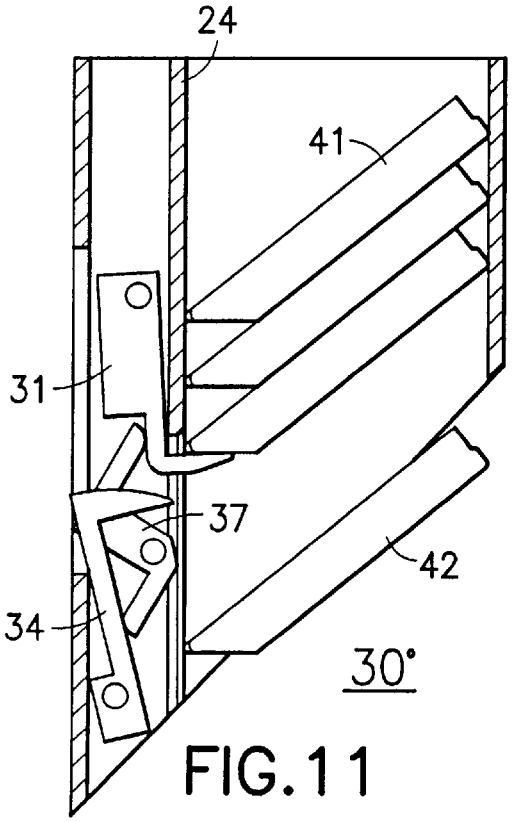
FIG. 11 is a cross-sectional view of an embodiment of a sequencing mechanism at thirty degrees of rotation.

FIG. 11 shows actuator 37 rotated thirty degrees. Catching member 31 almost contacts wall 24, is extended and firmly controls the stacked array 41. Holding member 34 completely releases the bottom-positioned support article 42.

Figure 12:
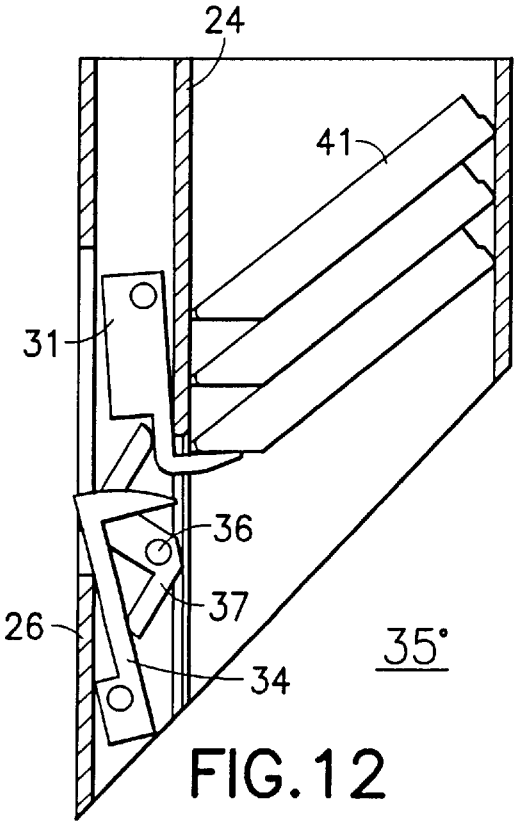
FIG. 12 is a cross-sectional view of an embodiment of a sequencing mechanism at thirty-five degrees of rotation.

FIG. 12 shows actuator 37 fully rotated at thirty-five degrees. Catching member 31 comes in contact with wall 24, and holding member 34 contacts wall 26. Both catching member 31 and holding member 34 have reached the limit of their respective rotations, and the sequence now begins to reverse, as shaft 36 is rotated in the opposite direction, back to neutral position, FIG. 5. The remaining articles shift down when released by catching member 31 and are held by holding member 34 until the next release, as the sequencing mechanism 300 cycles back from FIG. 12 to FIG. 5.

Figure 13:
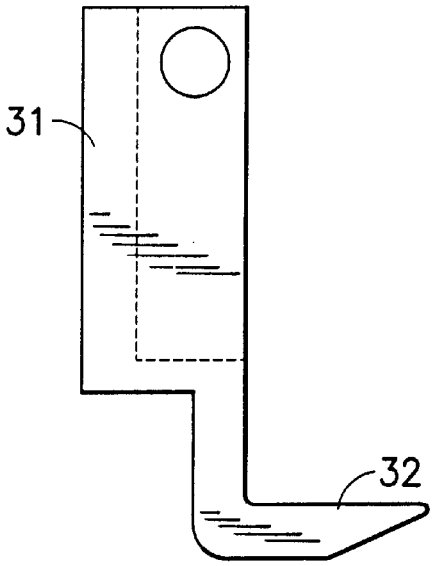
FIG. 13 is a side view of an embodiment of a catching member.

FIG. 13 is a side view of an embodiment of catching member 31, including a claw-like end 32 to capture stacked array 41 and to prevent multiple support articles from being released during sequential translation. The catching member includes a hole for the insertion of shaft 33. Extension member may be constructed of aluminum, stainless steel, or plastic.

Figure 14:
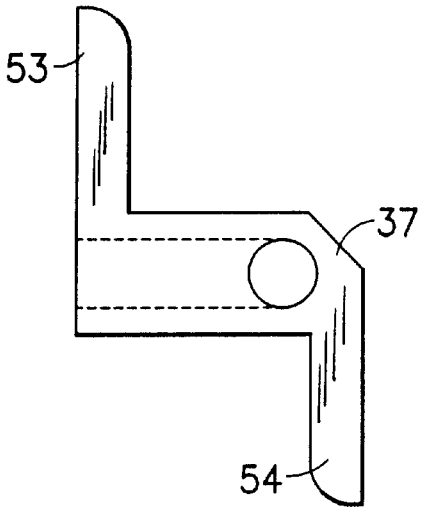
FIG. 14 is a side view of an embodiment of an actuator.

FIG. 14 is a side view of an embodiment of actuator 37 with arms 53 and 54. The actuator includes a hole for the insertion of the actuator shaft 36. Actuator 37 may be constructed of aluminum, stainless steel, or plastic.

Figure 15:
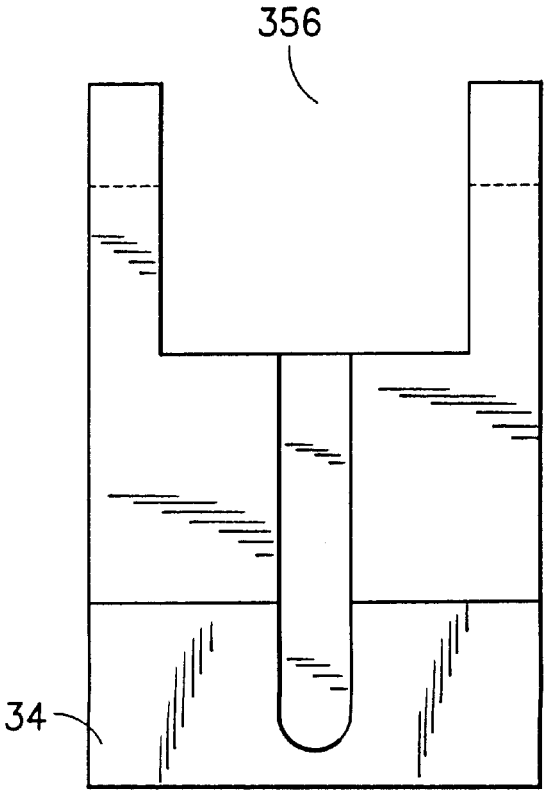
FIG. 15 is a front view of an embodiment of a holding member.

FIG. 15 is a front view of an embodiment of holding member 34. The holding member 34 may be constructed including an opening 356 to allow access of a stylus of the labeling device.

Figure 16:
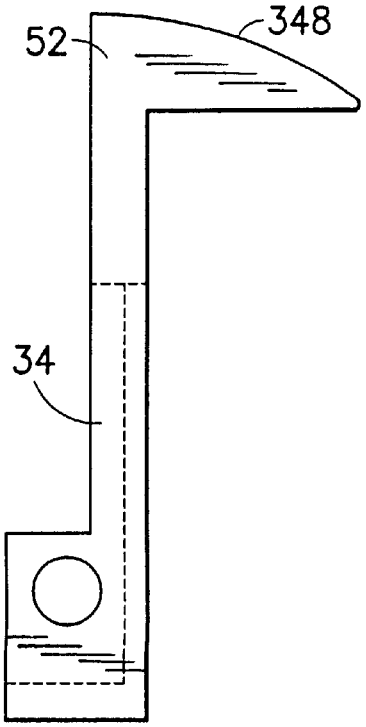
FIG. 16 is a side view of an embodiment of the holding member of FIG. 15.

FIG. 16 is a side view of an embodiment of holding member 34. The holding member includes at least one projection 52 to restrain bottom-positioned support article 42 which has a curved surface 348 to control the rate of release of the bottom-positioned support article 42 . Curved surface 348 can be altered to modify the rate of release of a support article. The holding member 34 includes a hole for the insertion of shaft 39. Holding member 37 may be constructed of aluminum, stainless steel, or plastic.

Figure 17:
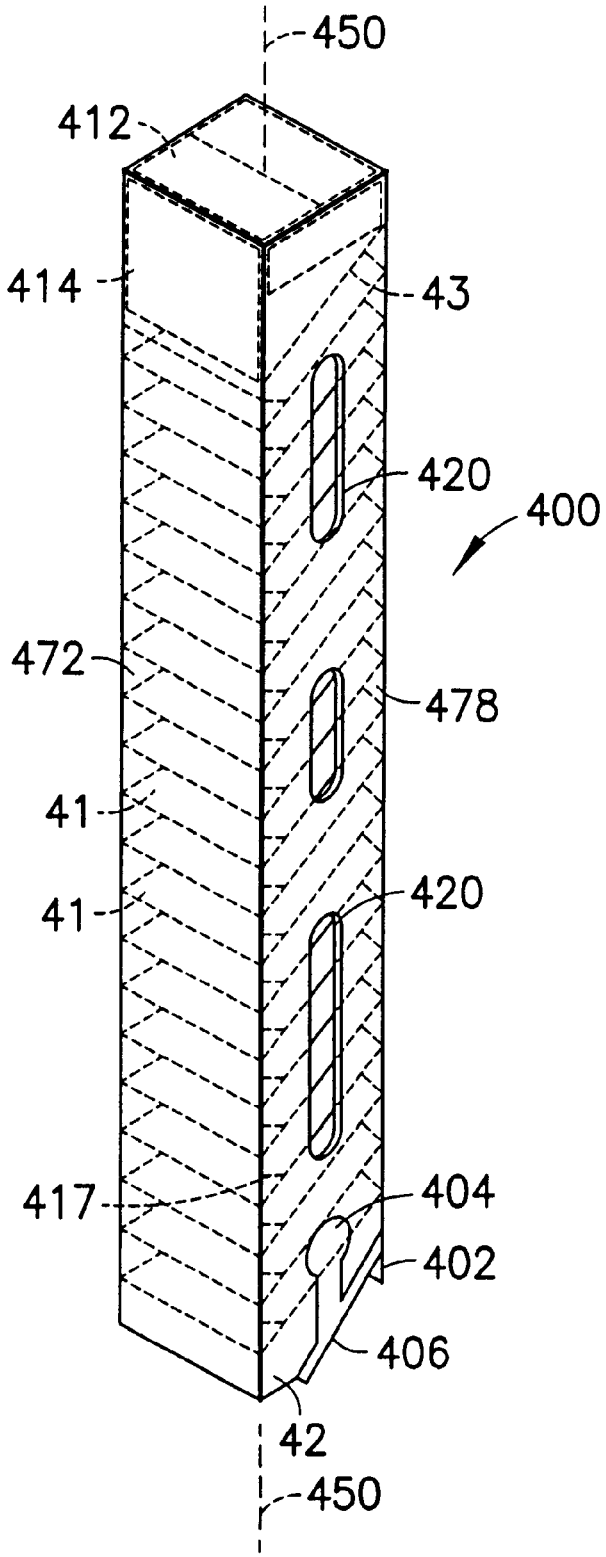
FIG. 17 is a perspective view of an embodiment of a magazine of the present invention.

FIG. 17 shows an embodiment of magazine 400. The magazine has an interior volume designed to maintain stacked array 41 in a desired orientation to the labeling device. Magazine 400 is shown, in this embodiment, devoid of any motive means or members as components thereof. Reference to the magazine as being "devoid of any motive means or members," as used herein, means the magazine has no moving parts which effect sequential dispensing of a bottom-positioned support article 42 from the stacked array. Magazine 400 is of elongate form defining a longitudinal axis 450 and the magazine has a rectangular cross-section transverse to the longitudinal axis. Magazine 400 is, in this embodiment, constructed of a paper product. The interior surface is provided with a low tack coating to minimize frictional forces between the dispensed articles 41 and the interior surface of magazine 400. View windows 420 are provided to monitor the dispensing level of articles 41. The paper product is scored and folded to form a first sidewall 472, a second sidewall 474 (not shown), a third sidewall 476 (not shown) opposite first sidewall 472, and a fourth sidewall 478 opposite the second sidewall with the fourth sidewall attached to the first sidewall. Support let 402 is an extension of side wall 478. Magazine 400 is supported within sleeve 250 by means of stop 202 of housing 200 as shown in FIG. 20. Since the magazine is constructed of a paper product, the magazine may be disposed of when devoid of articles 41.

The paper product used for magazine 400 can be obtained form various sources but must have a low tack, smooth side. Two suppliers of such paper include Gulf States Paper Corporation and Jefferson Smurfit Corporation. The smooth coated surface is achieved by using predominantly a hardwood pulp formed into a single ply paperboard countinuous web by a fourdinier paper machine. The fourdinier sheet is presssed to remove moisture. Smoothness is provide by the selection of press rolls and felting. A wet calender stack is used on the paperboard to impart a hard smooth finish. After removing moisture Magazine 400 may also include magazine top 412 and bottom pull-away lid 406. After stacking articles 41 into a stacked array within the interior volume of magazine 400, the magazine top is closed in a secured position by conventional closure flap inserts. An optional article support orientation insert 414 may be placed between top article 43 in the stacked array of articles 41 and the magazine top 412 to reduce article shifting during transportation of the magazine and assist in maintaining the stacked array 41 in a desired orientation to permit frontal face 417 of each article 41 to be correctly aligned with the support article labeling device 500.

Pull-away lid 406 is a detachable bottom of magazine 400 designed to be removed after the magazine has been inserted into sleeve 250 of support base 230 shown in FIGS. 18 and 19. Pull-away lid 406 is removeably secured to the bottom portion of magazine 400 by a serrated attachment of lid 406 to side wall 474 (not shown) opposite side wall 478 and an adhesive attachment of pull tab 404 to side wall 478. After magazine 400 has been inserted into a dispensing position within housing 200, pull tab 404 is detached from side wall 478 and pulled outwardly separating pull-away lid 406 from the bottom portion of magazine 400. Pull-away lid 406 may be removeably attached from magazine 400 by means other than a serrated edge or an adhesive attachment. For example, guides or slots means may also be provided to temporarily hold pull-away lid 406 in position until magazine 400 is placed in a dispensing position.

Figure 18A:
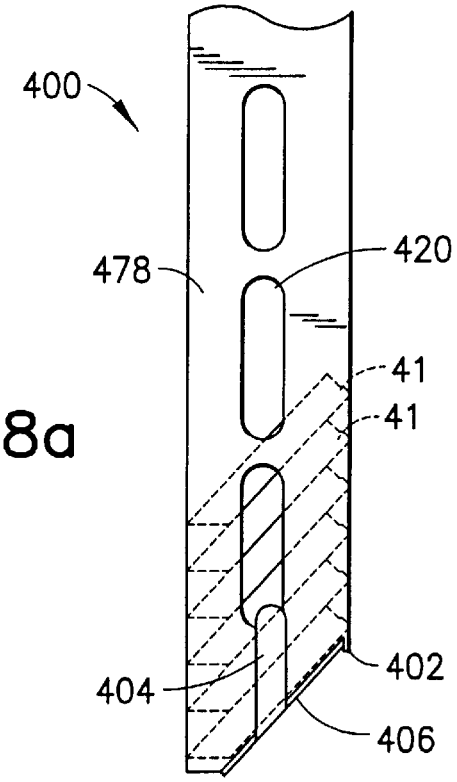
FIG. 18*a* is a side view of one embodiment of a magazine holding an array of cassette articles.
Figure 18B:
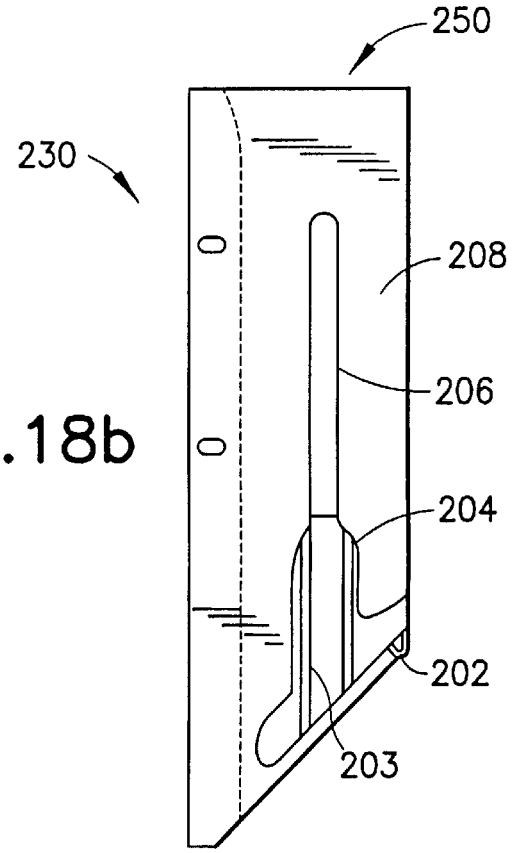
FIG. 18*b* is a side view of one embodiment of the base support member with a view slot for viewing the inserted magazine and stacked array of cassette articles.

FIGS. 18*a* and 18*b* are side views of magazine 400 and base support 230, respectively. As illustrated by FIGS. 18*a* and 18*b*, magazine 400 inserts into sleeve 250 of support base 230.

Magazine 400 is provided with view windows 420 to monitor the dispensing level of articles 41. Pull-away tab 406 is removeably attached to the dispensing end of magazine 400. When inserting magazine 400 through sleeve 250, magazine 400 is secured into position within base support 230 by stop 202 which holds support leg 402 of magazine 400. Front wall 208 is provided with view slot 206 for monitoring articles 41 through view windows 420 of magazine 400. Tab opening 204 is provided below view slot 206 to allow for access to pull tab 404 after magazine 400 has been fully inserted inside base support 230 through sleeve 250. Pull-away lid 406 is removeably attached to magazine 400 by means of a serrated tear end (not shown) attached to magazine 400 opposite side wall 478. Pull tab 404 is removeably adhered to side wall 478 and is preferably biased slightly outward so that it may be easily grasped after insertion of magazine 400 into sleeve 250. Base support 230 is provided with a back side support slot 203, which secures the assembly to the side wall of article labeling device 500 (depicted in FIGS. 1 and 20).

Figure 19A:
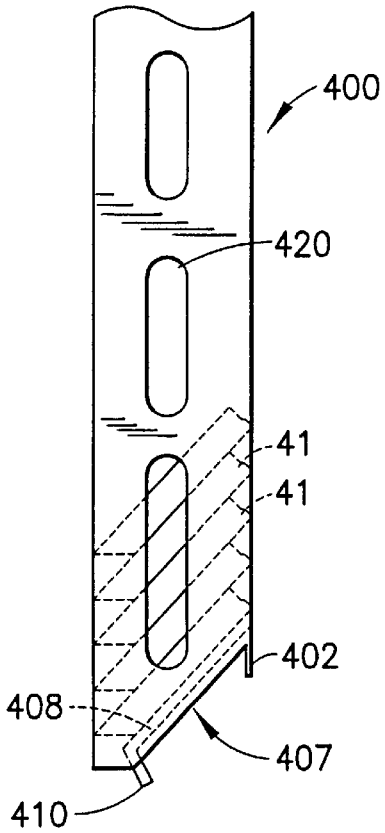
FIG. 19*a* is a side view of a second embodiment of a magazine holding an array of cassette articles.
Figure 19B:
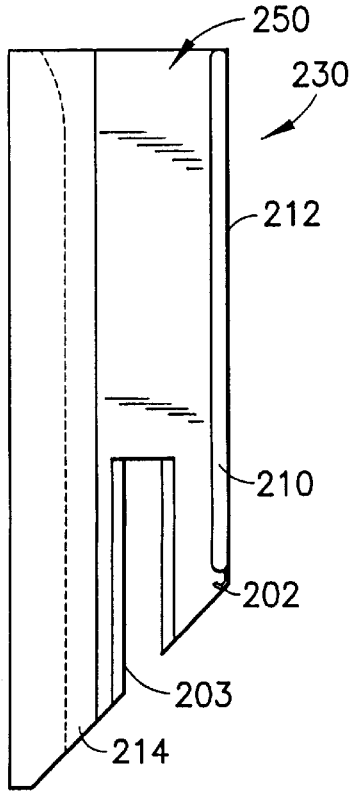
FIG. 19*b* is a side view of another embodiment of the base support member having an open front face.

FIGS. 19*a* and 19*b* illustrate an alternative embodiment of the present invention similar to that depicted in FIGS. 18*a* and 18*b*. Referring to FIG. 19*a* magazine 400 is provided with a stacked array of articles 41 that may viewed through view windows 420. The dispensing end 407 of magazine 400 is an alternative embodiment of the pull-away lid 406 shown in FIG. 18*a*. The exact configuration of the removable lid is not crucial so long as it serves the following functions: (1) the removable lid remains secure during movement and transportation of the magazine, and (2) the removable lid is easily detached from the magazine after insertion of the magazine inside the base support without interfering with the dispensing function of the assembly.

The removable lid 408 illustrated in FIG. 19*a* may be slideably attached, include multiple serrated tear edge attachments or be adhesively attached to dispensing bottom 407. FIG. 19*b* is an alternative embodiment of a support base 230 having an open front wall. Magazine guide 210 of rear wall 212 and front guide 214 secure magazine 400 from lateral movement after insertion of magazine 400 through sleeve 250 of support base 230. stop 202 of support base 230 holds support leg 402 of magazine 400 to prevent any downward slipping of the magazine after insertion of the magazine into the support base. After magazine 400 has been inserted into a dispensing position within base support member 230, pull tab 410 may be grasped and pulled in a downward and outward motion if the attachment means of removable lid 408 is by a serrated edge or adhesive attachment. If removable lid 408 is secured to dispensing end 407 by a slideable means, pull tab 410 may be grasped and slid out in a direction generally along the plane of the dispensing bottom. Base support 230 is provided with a back side support slot 203, which secures the assembly to the side wall of article labeling device 500 (depicted in FIGS. 1 and 20).

FIG. 20 is a sectional view of housing 200 along line A—A of FIG. 1. FIG. 20 shows an embodiment of assembly 100 in operative relation with support article labeling device 500. Magazine 400 is shown inserted into housing sleeve 250. Base support 230 is secured to article labeling device by wall prongs 505 that hook on to back side support slot 203. Third sidewall 274 also includes a lip or stop 202 holding support leg 402 to retain magazine 400. The stacked array of support articles 41 is vertically arranged with the individual support articles 41 abuttingly stacked one on another and disposed at an angle with respect to third sidewall 274. Each support article in the stacked array has a desired orientation. The desired orientation is determined by an angle of a support article frontal face 417 with respect to a bottom main surface 418 of the support article. A low friction coating is provided on along inside wall 416 to allow articles 41 to slide easily down the interior of magazine 400 as individual articles 41 are dispensed. Each support article must be held in the desired orientation to ensure each frontal face is properly labeled by the support article labeling device 500.

While the invention has been described with respect to the foregoing exemplary embodiments, the scope of the invention is not limited thereby, as other embodiments will be apparent to the skilled artisan given the teachings of the present invention as described herein and as such are intended within the scope of the present invention as claimed below.

What is claimed is:

1. An article dispensing apparatus for storing and sequentially translating support cassette articles in operative relation to a support cassette article labeling device, comprising:

a housing having a sleeve for receiving a plurality of support cassette articles, said support cassette articles being disposed in angular orientation to facilitate their interaction with the support cassette article labeling device;

a sequencing mechanism operatively connected to said housing to capture a stacked array of support cassette articles and translate a lowermost positioned support cassette article from the stacked array to the labeling device while substantially maintaining its orientation to the labeling device;

wherein the sequencing mechanism comprises a plurality of operatively related moveable parts for sequentially releasing the lowermost positioned support cassette article from the dispensing apparatus and coordinatingly halting release of a next lowermost positioned support cassette article by structurally supporting the next lowermost positioned support cassette article from below.

2. An article dispensing apparatus according to claim 1, wherein the moveable parts of the sequencing mechanism comprise:

a holding mechanism for supporting the lowermost positioned support cassette article in said stacked array;

a catching mechanism for catching and structurally holding said next lowermost positioned support cassette article from below when the holding mechanism is actuated to release the lowermost cassette of the stacked array; and an actuator mechanism operatively connected to the holding mechanism and the catching mechanism.

3. An article dispensing apparatus according to claim 2, wherein the actuator mechanism rotates between a resting position and a fully engaged position, wherein the resting position corresponds to the lowermost positioned support cassette article in the stacked array being held by the holding mechanism and wherein the fully engaged position corresponds to said lowermost positioned support cassette article being released while substantially maintaining orientation to the labeling device, while the next lowermost positioned support cassette article in the stacked array is held in place structurally from below by the catching mechanism.

4. An article dispensing apparatus according to claim 1, wherein:

the sleeve is constructed and arranged to removeably mount a magazine containing the stacked array of support cassette articles predisposed in angular orientation to facilitate their interaction with the support cassette article labeling device.

5. The dispensing apparatus of claim 4, further comprising:

at least one stop element to support the magazine within the sleeve of the dispensing apparatus, wherein the support cassette articles are operatively aligned with the sequencing mechanism to prevent misregistration of the lowermost positioned support article.

6. The apparatus of claim 4, wherein the magazine has an interior volume designed to maintain the stacked array in a desired orientation to the labeling device, the magazine having a dispensing end insertable into the housing sleeve and supported by said stop in operative position relative to the sequencing mechanism and wherein the sequencing mechanism translates a lowermost positioned support cassette article from the stacked array to the labeling device while substantially maintaining is orientation to the labeling device.

7. An article dispensing apparatus according to claim 4, wherein the magazine is of elongate form defining a longitudinal axis and the magazine has a rectangular cross-section transverse to the longitudinal axis.

8. An article dispensing apparatus according to claim 4, wherein the magazine further comprises a top at one end of the magazine and a detachable lid near the dispensing end of the magazine for securely containing the support cassette articles in place during transportation or movement of the magazine.

9. An article dispensing apparatus according to claim 8, wherein the detachable lid of the magazine further comprises a serrated edge removeably attached to at least one side of the magazine and a pull tab for pulling the detachable lid and tearing the serrated edge, detaching the detachable lid from the dispensing end of the magazine.

10. An article dispensing apparatus according to claim 8, wherein the detachable lid of the magazine is removeably attached to the dispensing end of the magazine by an adhesive attachment.

11. An article dispensing apparatus according to claim 4, wherein the magazine further comprises an interior wall having a low friction coating placed thereon to facilitate dispensing of support cassette articles.

12. An article dispensing apparatus according to claim 4, wherein the magazine is constructed of a paper product.

13. A support cassette article dispensing apparatus for storing and sequentially translating support cassette articles in operative relation to a sample support cassette article labeling device, comprising:

a housing having an interior volume for receiving a plurality of generally vertically stacked sample support cassette articles; and a sequencing mechanism for releasing the lowermost cassette and advancing the next lowermost cassette to the lowermost position, comprising:

a catching mechanism operatively connected to said housing and having a catching projection movable into engagement with said next lowermost cassette during a sequential translation said engagement structurally supporting the next lowermost cassette from below;

a holding mechanism operatively connected to the housing and having a holding projection movable between a first position wherein said projection supports the lowermost cassette in said stack and a second position for releasing said lowermost cassette while substantially maintaining the orientation of said lowermost cassette relative to the labeling device; and an actuator mechanism operatively coupled to said catching mechanism and to said holding mechanism to selectively and sequentially translate support cassette articles from the stacked array by coordinated sequential actuation of said catching and said holding mechanisms.

14. A sample support cassette article dispensing apparatus according to claim 13, wherein said holding mechanism operates to retain the next lowermost cassette, substantially maintaining its orientation to the labeling device, when said activator is deactivated.

15. A sample support article dispensing apparatus according to claim 13, wherein the housing further comprises a sleeve constructed and arranged to removeably mount a magazine containing the stacked array of support cassette articles, wherein the magazine has an interior volume designed to maintain the stacked array in the desired orientation to the support article labeling device, the magazine having a dispensing end insertable into the housing sleeve, and supported in operative position relative to the holding mechanism.

16. A sample support article dispensing apparatus according to claim 15, wherein said sleeve of said housing further comprises a front wall having an elongated view slot for visually monitoring the stacked array of support article cassettes being dispensing.

17. A sample support article dispensing apparatus according to claim 15, wherein said magazine is of an elongated form defining a longitudinal axis and the magazine has a rectangular cross-section transverse to the longitudinal axis.

18. A sample support article dispensing apparatus according to claim 17, wherein said magazine is constructed of a paper product that is scored and folded to form a first sidewall, a second side wall, a third sidewall opposite the first side wall, and a fourth sidewall opposite the second sidewall with the fourth sidewall attached to the first side wall.

19. A sample support article dispensing apparatus according to claim 18, wherein at least one sidewall of said magazine is provided with a view window to visually monitor the stacked array of support article cassettes being dispensing.

20. An article dispensing apparatus according to claim 15, wherein the magazine further comprises a top having a support cassette article orientation insert at one end of the magazine and a detachable lid near the dispensing end of the magazine for securely containing the support cassette articles in place during transportation or movement of the magazine.

21. An article dispensing apparatus according to claim 20, wherein the detachable lid of the magazine further comprises a serrated edge removeably attached to at least one side of the magazine and a pull tab for pulling the detachable lid and tearing the serrated edge, detaching the detachable lid from the dispensing end of the magazine.

22. An article dispensing apparatus according to claim 21, wherein said sleeve of said housing further comprises a tab opening for easy access to said pull tab after the magazine has been inserted inside said housing.

23. An article dispensing apparatus according to claim 20, wherein the detachable lid of the magazine is removeably attached to the dispensing end of the magazine by an adhesive attachment.

24. An article dispensing apparatus according to claim 15, wherein the magazine further comprises an interior wall having a low friction coating placed thereon to facilitate dispensing of support cassette articles.

25. A support article dispensing assembly according to claim 15, further comprising a stop cooperating with the holding mechanism to maintain the stacked array in a desired orientation and to prevent more than one support article from releasing during the sequential translation of a support article.

26. A sample support article dispensing apparatus according to claim 15, wherein the housing and the magazine are formed of an extruded material.

27. A sample support article dispensing apparatus according to claim 13, wherein the actuator mechanism comprises an actuator member rotatably mounted between a first sidewall of the housing and an opposite second sidewall of the housing.

28. A sample support article dispensing apparatus according to claim 27, wherein the actuator member includes a first arm engaging and activating the catching mechanism and a second arm engaging and activating the holding mechanism.

29. A sample support article dispensing apparatus according to claim 27, wherein the actuator mechanism further comprises a drive shaft rotatably mounted between the first sidewall of the housing and the opposite second sidewall of the housing, the actuating member operatively connected to said drive shaft such that said actuator rotation is driven by said drive shaft rotation.

30. An article dispensing apparatus according to claim 29, wherein the actuator mechanism further includes a set screw threadably received in the actuator member for fixing the actuating member to the drive shaft to prevent rotational slippage.

31. An article dispensing apparatus according to claim 29, wherein the drive shaft further includes an end for engaging a driver of the support article labeling device to initiate the actuator mechanism and cause the sequential translation.

32. An article dispensing apparatus according to claim 29, further including; a coupler for activating said actuator mechanism in response to actuation from said support article labeling device.

33. An article dispensing apparatus according to claim 13, wherein the catching mechanism comprises a catching member rotatably mounted between a first sidewall of the housing and an opposite second sidewall of the housing to catch and structurally support from below the next lowermost support cassette article in the stacked array.

34. An article dispensing apparatus according to claim 33, wherein the catching member includes a projection to retain the stacked array by structurally supporting it from below, above the bottom-positioned support article and to prevent multiple support cassette articles from being released during the sequential translation.

35. An article dispensing apparatus according to claim 33, wherein the catching mechanism comprises a shaft rotatably mounted between the first sidewall of the housing and the opposite second sidewall of the housing, the catching member mounted on the shaft.

36. An article dispensing apparatus according to claim 13, wherein the holding mechanism comprises a holding member rotatably mounted between a first sidewall of the housing and an opposite second sidewall of the housing.

37. An article dispensing apparatus according to claim 36, wherein the holding member includes at least one projection designed to hold the lowermost positioned article in a fixed position in substantially its predisposed orientation relative to the labeling device in the stacked array, for labeling by the article labeling device.

38. An article dispensing apparatus according to claim 37, wherein the holding mechanism further comprises a shaft rotatably mounted between the first sidewall of the housing and the opposite second sidewall of the housing, the holding member mounted to the shaft.

39. An article dispensing apparatus according to claim 13, wherein each projection includes a curved surface to control a rate of release of the lowermost positioned support article in substantially its predisposed orientation relative to the labeling device in the stacked array.

40. An article dispensing apparatus according to claim 38, wherein the holding mechanism further comprises a spring to restore the holding member to a neutral position after the sequential translation is complete.

41. A replacement magazine for an article dispensing apparatus for storing and sequentially translating articles having a housing for receiving a plurality of vertically stacked articles predisposed in orientation to facilitate interaction with the labeling device, a sequencing mechanism for releasing the lowermost article in substantially its predisposed orientation relative to the labeling device and advancing the remaining stack, and a stop for supporting a magazine in the housing, the magazine comprising sidewalls forming a generally rectangular, elongated internal cavity for retaining a plurality of articles in a predetermined angular orientation.

42. An article dispensing apparatus according to claim 41, wherein the magazine further comprises a top having a support cassette article orientation insert at one end of the magazine and a bottom lid at a dispensing end of the magazine for securely containing the support cassette articles in place during transportation or movement of the magazine.

43. An article dispensing apparatus according to claim 42, wherein the support cassette article orientation insert maintains the stacked array in a desired orientation to permit a frontal face of each support article to be correctly aligned with the support article labeling device.

44. An article dispensing apparatus according to claim 42, wherein the bottom lid is a detachable lid.

45. An article dispensing apparatus according to claim 44, wherein the detachable lid of the magazine comprises a serrated edge removeably attached to at least one sidewall of the magazine.

46. An article dispensing apparatus according to claim 44, wherein the detachable lid of the magazine further comprises a pull tab for detaching the detachable lid from the dispensing end of the magazine.

47. An article dispensing apparatus according to claim 44, wherein the detachable lid of the magazine is removeably attached to the dispensing end of the magazine by adhesive means.

48. An article dispensing apparatus according to claim 41, wherein the magazine further comprises an interior wall having a low friction coating placed thereon to facilitate dispensing of the support cassette articles.

49. A sample support article dispensing apparatus according to claim 42, wherein the top is constructed of a paper product scored and folded to form the article orientation insert.

50. A sample support article dispensing apparatus according to claim 42, wherein the bottom lid includes an orientation feature designed to maintain the stacked array in the desired orientation to permit a frontal face of each support article to be correctly aligned with the support article labeling device.

51. A sample support article dispensing apparatus according to claim 42, wherein the magazine is constructed of a paper product.

52. A sample support article dispensing apparatus according to claim 51, wherein the paper product is scored and folded to form a first sidewall, a second sidewall, a third sidewall opposite the first sidewall, and a fourth sidewall opposite the second sidewall with the fourth sidewall attached to the first sidewall.

53. A sample support article dispensing apparatus according to claim 42, wherein at least one sidewall of said magazine is provided with a view window to visually monitor the stacked array of support article cassettes being dispensing.

* * * * *